US008522410B2

(12) United States Patent
Parisi et al.

(10) Patent No.: US 8,522,410 B2
(45) Date of Patent: Sep. 3, 2013

(54) BUCKLE

(75) Inventors: Brian M Parisi, Evanston, IL (US); Scott D Kolasa, Mt Prospect, IL (US); Craig E Ernst, Jr., Marlboro, NY (US); Jeffrey D Anderson, Hampshire, IL (US)

(73) Assignee: Illinois Tool Works, Glenview, IL (US)

( * ) Notice: Subject to any disclaimer, the term of this patent is extended or adjusted under 35 U.S.C. 154(b) by 253 days.

(21) Appl. No.: 12/933,943

(22) PCT Filed: Apr. 13, 2009

(86) PCT No.: PCT/US2009/040304

§ 371 (c)(1), (2), (4) Date: Sep. 22, 2010

(87) PCT Pub. No.: WO2009/134608

PCT Pub. Date: Nov. 5, 2009

(65) Prior Publication Data

US 2011/0030180 A1 Feb. 10, 2011

Related U.S. Application Data

(60) Provisional application No. 61/049,952, filed on May 2, 2008, provisional application No. 61/112,822, filed on Nov. 10, 2008.

(51) Int. Cl.
*A44B 11/25* (2006.01)

(52) U.S. Cl.
USPC ..... 24/634; 24/615; 24/606

(58) Field of Classification Search
USPC ..... 24/593.1, 594.1, 598.1, 598.4, 606, 24/615, 616, 625, DIG. 44, DIG. 47, DIG. 48, 24/DIG. 51, 614, 630, 634, 637, 641
See application file for complete search history.

(56) References Cited

U.S. PATENT DOCUMENTS

| | | | |
|---|---|---|---|
| 2,896,288 | A | 7/1959 | Davis |
| 3,188,707 | A | 6/1965 | Schmidt |
| 3,871,090 | A | 3/1975 | Romanzi, Jr. et al. |
| 4,468,843 | A | 9/1984 | Duclos et al. |
| 4,752,263 | A | 6/1988 | Pritchard et al. |
| 5,531,622 | A | 7/1996 | Nealy |
| 6,189,348 | B1 | 2/2001 | Huang |
| 6,487,761 | B2 | 12/2002 | Van Tassel |
| 6,637,083 | B1 | 10/2003 | Howell |
| 6,931,695 | B2 | 8/2005 | Anscher |
| 7,073,234 | B2 | 7/2006 | Turpin |

OTHER PUBLICATIONS

ISR for PCT/U52009/040304 mailed Jun. 4, 2009.

*Primary Examiner* — Robert J Sandy
*Assistant Examiner* — Abigail E Morrell
(74) *Attorney, Agent, or Firm* — Lowe Hauptman, Ham & Berner LLP

(57) ABSTRACT

A releasable buckle including a latch having locking arms adapted to lockingly engage a female component. A folding bridge structure extends between the locking arms. The bridge structure includes a pivot connection zone adapted to engage an elongate release member. Upon tensioning the elongate release member the locking arms are pulled inwardly to disengage from the female component.

20 Claims, 7 Drawing Sheets

BUCKLE

CROSS REFERENCE TO RELATED APPLICATIONS

The present non-provisional United States patent application claims the benefits of U.S. Provisional Applications 61/049,952 filed on May 2, 2008, and 61/112,822 filed on Nov. 10, 2008, the contents of all of which are incorporated herein in their entirety.

FIELD OF THE INVENTION

The present invention relates generally to buckles that include a male component adapted for snapped relation into a female component, with release effected by inward movement of locking members to disengage the male component from a locked condition in the female component.

BACKGROUND OF THE INVENTION

Two-piece buckles that snap together and latch automatically upon adequately inserting a male component into a female component are known and are used in a variety of applications. A piece of webbing can be attached to one or both of the buckle components, and one or both buckle components can be adjustably retained on the webbing. It is also known to have both components in fixed locations relative to a strap or web that is sewn or otherwise fixedly secured to the buckle component. Such buckles are known and use for a variety of application, including outdoor recreational products such as backpacks, bike helmets, life vests and other equipment. Two-part buckles are used also on luggage, bags, clothing and the like.

In one known design for buckles of this type, the female component defines a receiving body and includes openings or windows on the lateral, opposed sides of the receiving body. The male component includes arms having outward protrusions slightly wider than the width of the female component at some positions from the entrance to the window. As the male component is inserted into the female component, the arms are deflected inwardly and thereafter are allowed to rebound outwardly when the protrusions align with the windows in the female component. With the protrusion extending slightly outwardly at the window, the male component is secured within the female component. For added security, additional confronting surfaces on the male and female components engage one against another as the male component reaches a final, locked position. The locked relation is released by squeezing the protrusions inwardly from the window, and pulling the male member outwardly.

According to another known construction, a pair of anchoring lines are attached at the arms of the male member. The anchoring lines extend inwardly away from the arms to a central elongate box channel oriented generally parallel to the arms. The anchoring lines are threaded through openings in walls of the elongate box channel and run rearwardly along the length dimension of the elongate box channel towards a base portion of the male member. By pulling the anchoring lines in a rearward direction, the arms are pulled inwardly towards the box channel. The inward movement of the arms causes a release from the female member.

While buckles of the type described have had success in many application, they are not without deficiencies. For example, to improve resistance to unintended release of the buckle when the buckle is placed under load, bulky, thick components have been used. Some buckles are difficult to release when under load. While such buckles may release easily when not under load, if the engaging surfaces are directed angularly forward, release requires movement of the male lock arms such that the male member is actually driven deeper into the female component as engaging surfaces slide beyond each other. When under load, this causes an increase in the load, and as a result, the release mechanism can be difficult to operate. Further, in manufacturing prior buckles, large tolerances have been used. Accordingly, when latched but not under load, the male and female components may feel loosely fit one in the other and may even rattle or otherwise move one with respect to the other. While such looseness may not affect overall performance of the buckle, the use may feel that the buckle is not secure. The user may adjust the adjustable strap to make the strap exceedingly taut so that rattle is eliminated in that the buckle is under continuous load. This, then, can result in the aforementioned difficulty in releasing the buckle under load.

SUMMARY OF THE INVENTION

The present invention provides a buckle with a folding bridge structure extending between locking arms. The bridge structure includes a pivot connection zone adapted to engage an elongate release member to pull the locking arms inwardly upon tensioning the release member.

In one aspect thereof, the present invention provides a buckle including a female buckle component including an entrance opening and an interior. The buckle further includes a male buckle component including a latch portion adapted for insertion into the female buckle component through the entrance opening. The latch portion includes a first lock arm and a second lock arm. The first lock arm and the second lock arm are disposed in spaced relation to one another. The first lock arm includes a first distal portion and a first proximal portion relative to the entrance opening. The second lock arm includes a second distal portion and a second proximal portion relative to the entrance opening. A flexible bridge member extends in depressed profile spanning relation between the first lock arm and the second lock arm. The bridge member includes a first bridge segment normally extending in angled relation away from the first distal portion of the first lock arm. The bridge member further includes a second bridge segment extending in angled relation away from the second distal portion of the second lock arm. An elongate tensioning member is operatively connected to the bridge member at a depressed connection zone between the first lock arm and the second lock arm. The elongate tensioning member extends rearwardly away from the connection zone to a position outside the buckle. The tensioning member is adapted to draw the connection zone towards the entrance opening upon application of tensioning force along the tensioning member such that the bridge member is at least partially folded and the first lock arm and the second lock arm are pulled towards one another.

Other features and advantages of the invention will become apparent to those skilled in the art upon review of the following detailed description, claims and drawings in which like numbers are used to designate like features.

DETAILED DESCRIPTION OF THE PREFERRED EMBODIMENTS

Figure 1:
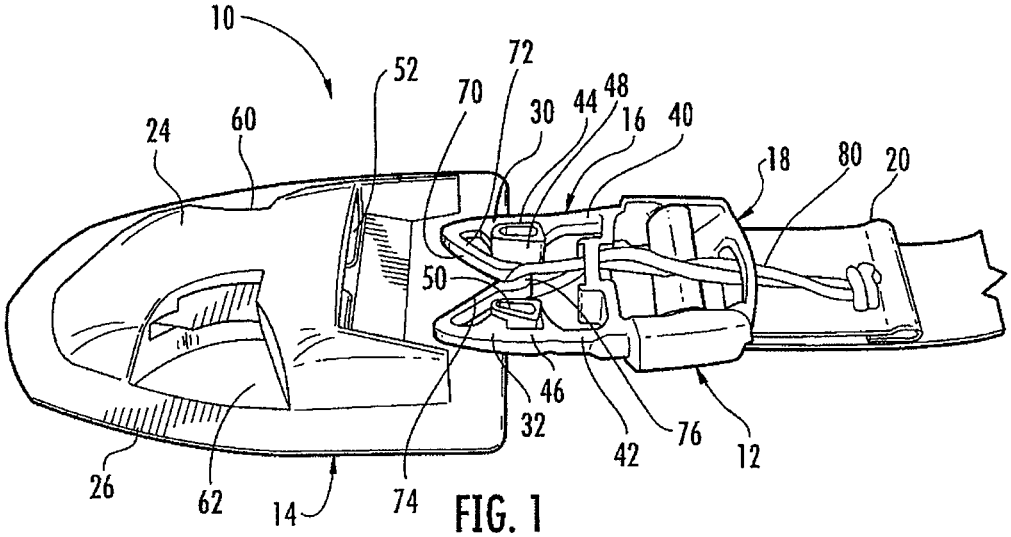
FIG. 1 is a view of one exemplary embodiment of a buckle in accordance with the present invention.

Referring now more specifically to the drawings and to FIG. 1 in particular, a buckle 10 in accordance with the present intention is shown. Buckle 10 includes a male component 12 and a female component 14. The male component 12 includes a latch 16 and a web attachment structure 18 adapted to engage a web 20 such as an elongate strap or the like. The female component 14 includes a generally hollow receiving body 24 and a perimeter skirt 26 disposed around the receiving body 24. The perimeter skirt 26 may be a generally flat piece of plastic integrally molded with the receiving body although other materials may likewise be used. As will be described further hereinafter, The perimeter skirt 26 defines an attachment zone for adjoining the female component 14 to a support substrate such as a fabric or the like using stitching, adhesive bonding or other attachment techniques as may be desired.

The latch 16 is inserted into and received by the receiving body 24 of the female component 14 whereby buckle 10 is latched. The male component 12 and the female component 14 can be made as individual monolithic structures of plastic formed by injection molding processes, or the like. However, it is likewise contemplated that other materials of construction such as metals or the like may be used to form one or both components if desired.

Figure 4:
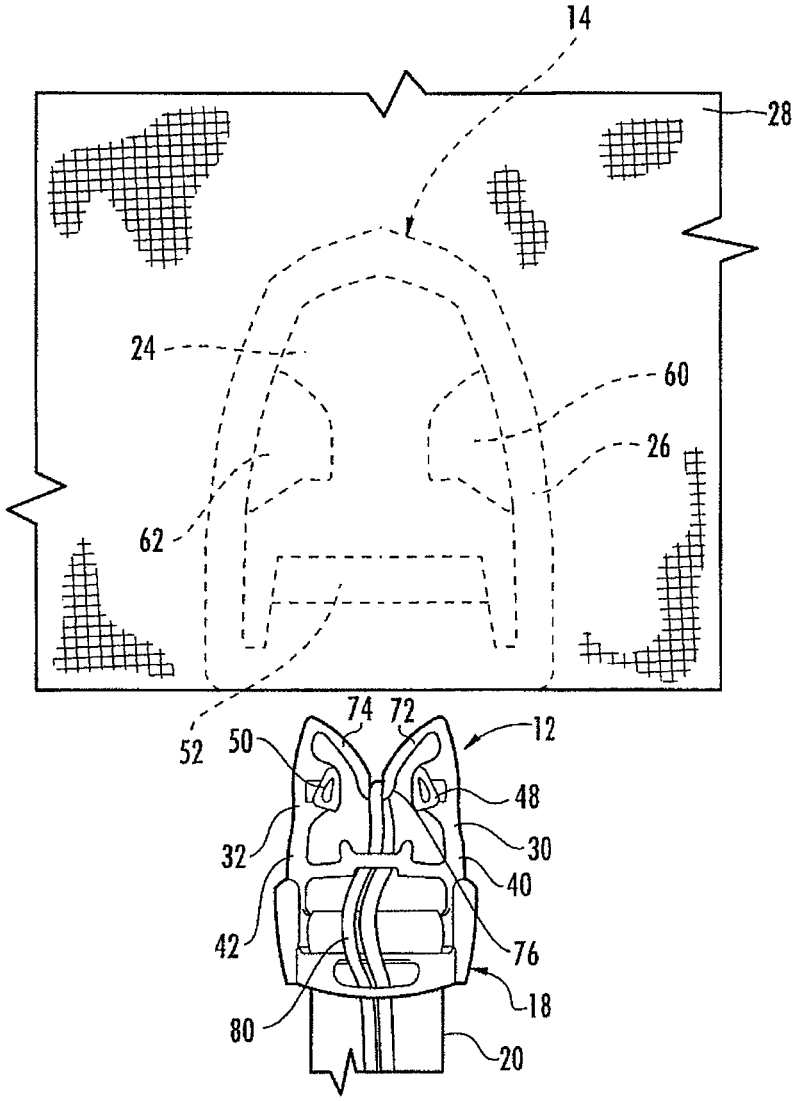
FIG. 4 is a view illustrating the buckle shown in FIG. 1 with the female component disposed within a pocket of a fabric or other support structure.

The web 20 can be threaded through an opening in the web attachment structure 18. This provides a secure relation between the web 20 and the male component 12. As illustrated schematically in FIG. 4, in accordance with one contemplated practice, the female component 14 may be held within a pocket opening formed between layers of a multilayer fabric support substrate 28. As previously noted, following insertion, the female component 14 may be secured in place by stitching through the perimeter skirt 26. In this arrangement, the fabric support substrate 28 substantially encapsulates the female component with the exception of an opening for insertion of the male component 12.

In the exemplary construction illustrated in FIGS. 1-4, the latch 16 of the male component 12 includes first and second latch arms 30, 32 projecting outwardly from the web attachment structure 18 of the male component 12. The latch arms 30, 32 are mirroring structures that extend into the female component 14 when the buckle 10 is latched. Proximal ends of the latch arms 30, 32 define relatively thin flex segments 40, 42 respectively. The latch arms 30, 32 further include bulbous portions 44, 46 respectively located forward of the flex segments 40, 42. The bulbous portions 44, 46 project laterally outwardly from axes defined by the non-deflected conditions of the flex segments 40, 42, respectively. Upon lateral force exerted against the bulbous portions 44, 46, the latch arms 30, 32 deflect or bend along flex segments 40, 42, respectively, proximate the web attachment structure 18.

In the illustrated exemplary construction, latching structures 48, 50 are provided inwardly of the latch arms 30, 32 and inwardly of the axes defined by non-deflected flex segments 40, 42. Latching structures 48, 50 are thicker than the flex segments 40, 42 and extend above and below planes defined by upper and lower surfaces of the flex segments 40, 42. The configuration and operation of the latching structures 48, 50 is illustrated and described in United States Patent Application 2008/0134479, the teachings of which are incorporated by reference herein in their entirety.

Figure 2:
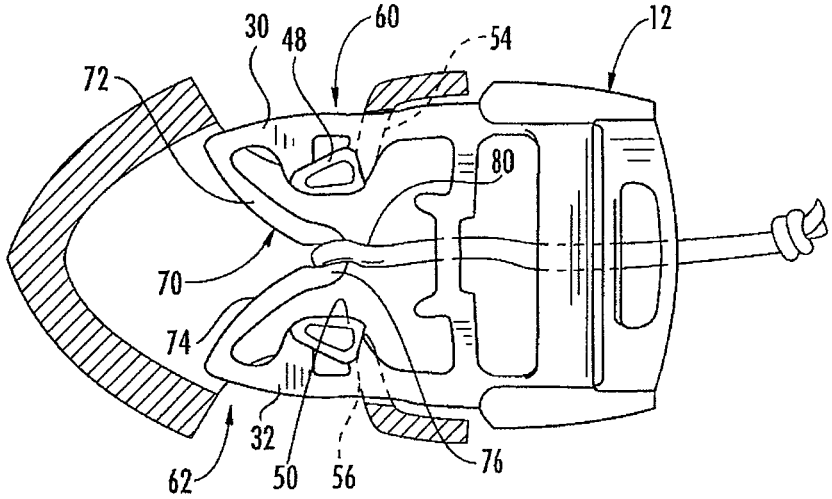
FIG. 2 is a partial cross-sectional view of the buckle shown in FIG. 1 but showing the buckle in a latched condition, with the female buckle component shown in cross-section.

Upon insertion of the male component 12 into an entrance opening 52, the latching structures 48, 50 cooperate with pediments 54, 56 to retain buckle 10 in a latched condition as best illustrated in FIG. 2. More particularly, as the latch 16 is inserted into the receiving body 24 the latch arms 30, 32 pass along interior sides of the receiving body 24. During insertion, the leading edges of the latching structures 48, 50 engage the pediments 54, 56. With continued inward insertion, the bulbous portions 44, 46 and the latching structures 48, 50 deflect inwardly by camming action between the latching structures 48, 50 and the corresponding pediments 54, 56. Upon achieving full insertion with the latching structures 48, 50 positioned forward of the pediments 54, 56 the latch arms 30, 32 rebound outwardly. In moving outwardly, the latching structures 48, 50 are moved from inner to outer positions and lock behind the pediments 54, 56. In this locked condition, the bulbous portions 44, 46 are accessible through window openings 60, 62 respectively.

In the locked condition, applying tension to the web 20 or other structure connected to the female component 14 does not cause separation. To unlatch or disengage the buckle 10, the bulbous portions 44, 46 may be pressed inwardly at the window openings 60, 62 such that the latch arms 30, 32 are deflected inwardly by bending along flex segments 40, 42. Upon inward bending of arms 30, 32, the latching structures 48, 50 are moved inwardly, away from direct confrontation with the pediments 54, 56. Continued withdrawal of latch 16 from the receiving body 24 provides inward deflection of arms 30, 32, until the cam surfaces clear one another and the male component 12 pops free of the female component 14.

As illustrated, in the exemplary construction a hinging bridge member 70 extends in spanning relation between the latch arms 30, 32. The bridge member 70 includes a first bridge segment 72 extending away from the latch arm 30 and a second bridge segment 74 extending away from the latch arm 32. As shown, the bridge segments 72, 74 are operatively connected at distal portions of the latch arms 30, 32 at positions forward of the corresponding bulbous portions 44, 46. As shown, the bridge segments 72, 74 may be integral with the corresponding latch arms 30,32. The bridge segments 72, 74 and the latch arms are preferably formed from the same material such as plastic or the like during a molding process.

Alternatively, the bridge segments 72, 74 may be formed independently from the latch arms 30, 32 with operative connection being made by heat welding, adhesive bonding or the like to provide a secure connection.

As shown, the bridge segments 72, 74 intersect with one another at a connection zone 76 adapted to operatively engage a tension activated release lanyard 80 of elongate geometry. As shown, in the exemplary construction the connection zone 76 is disposed generally along a central axis of the male component 12. In the illustrated arrangement, the bridge segments 72, 74 are slightly arched and extend generally in rearward angled relation away from the distal ends of the corresponding latch arms such that the overall bridge member 70 has a generally depressed profile concave cusp-shaped configuration with the base of the cusp defining the connection zone 76. By way of example only, and not limitation, it is likewise contemplated that the bridge member may incorporate other depressed profile configurations such as a "V" shaped structure, "U" shaped structure or the like if desired.

Regardless of the configuration of the bridge member 70, the operative connection between the bridge member 70 and the release lanyard 80 may be used to remotely activate the release of the male component 12 from the female component 14. Such release is best illustrated through joint reference to FIGS. 2 and 3. As shown in FIG. 2, when the male component 12 is in locked relation within the female component 14, the latch arms 30, 32 are in a locking outward position. In this locked position, the latching structures 48, 58 are blocked from withdrawal by the corresponding pediments 54, 56.

Figure 3:
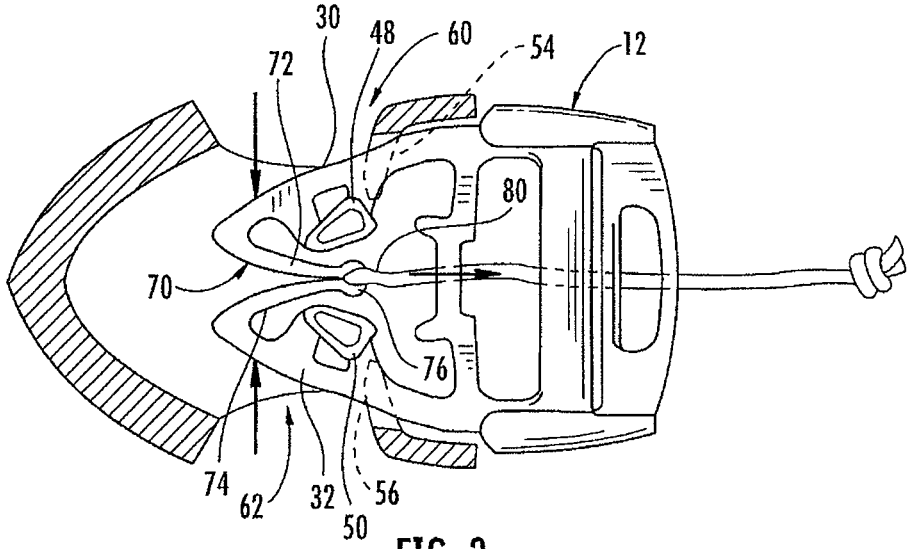
FIG. 3 is a partial cross-sectional view similar to that of FIG. 3 but illustrating the lock arms of the male buckle component in a released position so that the buckle can be separated.

As illustrated in FIG. 3, when a rearward tensioning force is applied to the release lanyard 80 as shown by the directional arrow, the connection zone 76 is pulled rearwardly in the direction of the applied tensioning force and the bridge segments 72, 74 are drawn towards one another. That is, the bridge member 70 hinges about the connection zone 76 to fold upon itself. As the bridge segments 72, 74 move towards one another, the latch arms 30, 32 are likewise pulled in. As the latch arms 30, 32 are pulled in, the latching structures 48, 50 move out of blocked engagement with the corresponding pediments 54, 56 thereby permitting release.

In the illustrated arrangement, the release lanyard 80 extends in a substantially straight path from the connection zone 76 rearwardly to a position beyond the latch 16. Accordingly, a user may access the release lanyard 80 when the latch is held at the interior of the receiving body 24. As noted previously, the locked condition of FIG. 2 is maintained when tension is applied to the web 20. However, when tension is applied to the release lanyard 80, the latch 16 is adjusted to an unlocked state as shown in FIG. 3 which permits separation. Of course, release may also be achieved by applying inward pressure to the latch arms 30, 32 through the window openings 60, 62 as in prior designs.

Figure 5:
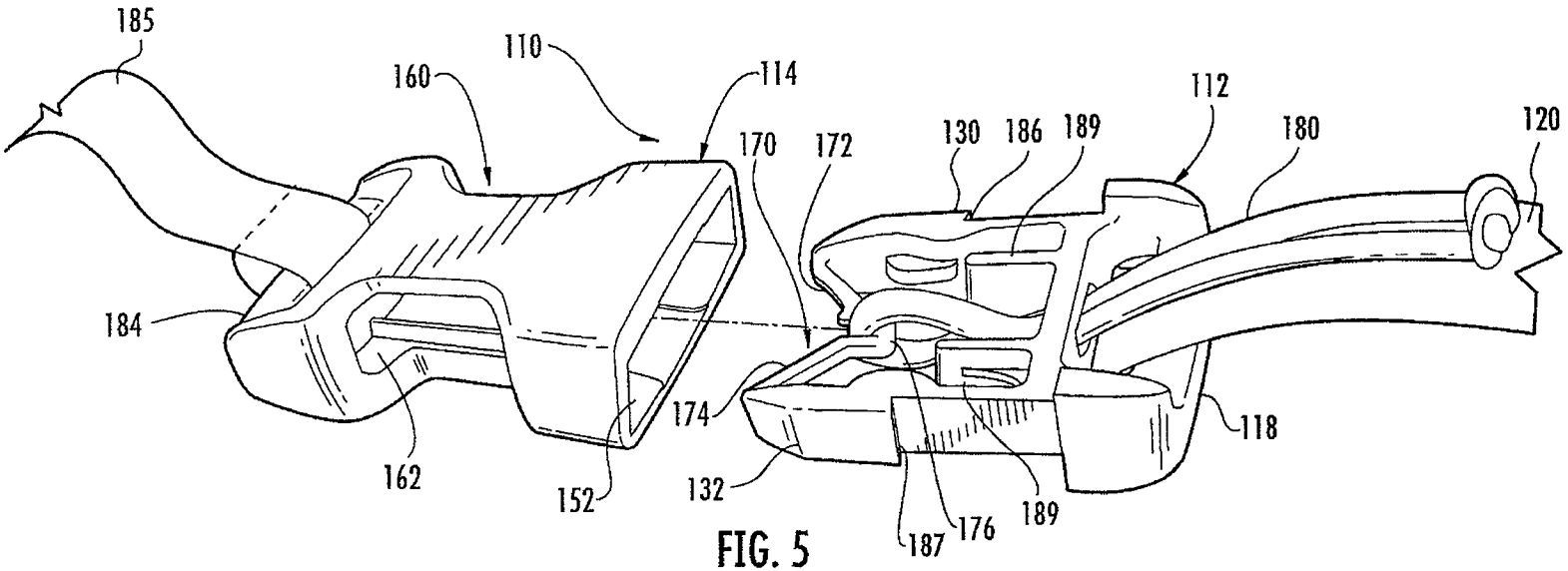
FIGS. 5-7 are views similar to FIG. 1 illustrating alternative exemplary buckle configurations in accordance with the present invention.

While the configuration illustrated in FIGS. 1-4 may be desirable for many environments of use, it is likewise contemplated that numerous other configurations may be utilized if desired. By way of example only, and not limitation, FIG. 5 illustrates an alternative construction for a buckle 110 in accordance with the present invention. In FIG. 5, elements corresponding to those previously described are designated by like reference numerals within a 100 series. In the exemplary construction of FIG. 5, the female component 114 includes a web attachment bar 184 adapted to engage a second web 185 or other connection element extending generally away from the web 120. Thus, the buckle 110 may define a releasable connective interface between the web 120 and the second web 185. As shown, in the configuration of FIG. 5, the bridge member 170 has a generally "V" shaped configuration wherein the bridge segments 172, 174 are generally linear. The connection zone 176 has a depressed stirrup configuration adapted to engage a distal end of the release lanyard 180.

The operation of the buckle 110 of FIG. 5 is substantially similar to that previously described in relation to FIGS. 1-4. Specifically, as latch arms 130, 132 are inserted into entrance opening 152, the latch arms 130, 132 are biased inwardly by a cam action between the chamfered edges of the latch arms and the sides of the female component 114. Once insertion is complete, the latch arms spring outwardly such that bulbous portions are held within window openings 160, 162. Outward withdrawal is blocked by shoulders 186, 187. Thus, the buckle 110 remains in a locked condition even upon the application of tension to the web 120 and the second web 185. However, when tension is applied to the release lanyard 180, the latch arms 130, 132 are pulled inwardly to an unlocked state which permits separation. Posts 189 running in substantially parallel, spaced relation to the latch arms prevent excessive inward deflection of the latch arms during release. Of course, release may also be achieved by applying inward pressure to the latch arms 130, 132 through the window openings 160, 162 if desired.

Figure 6:
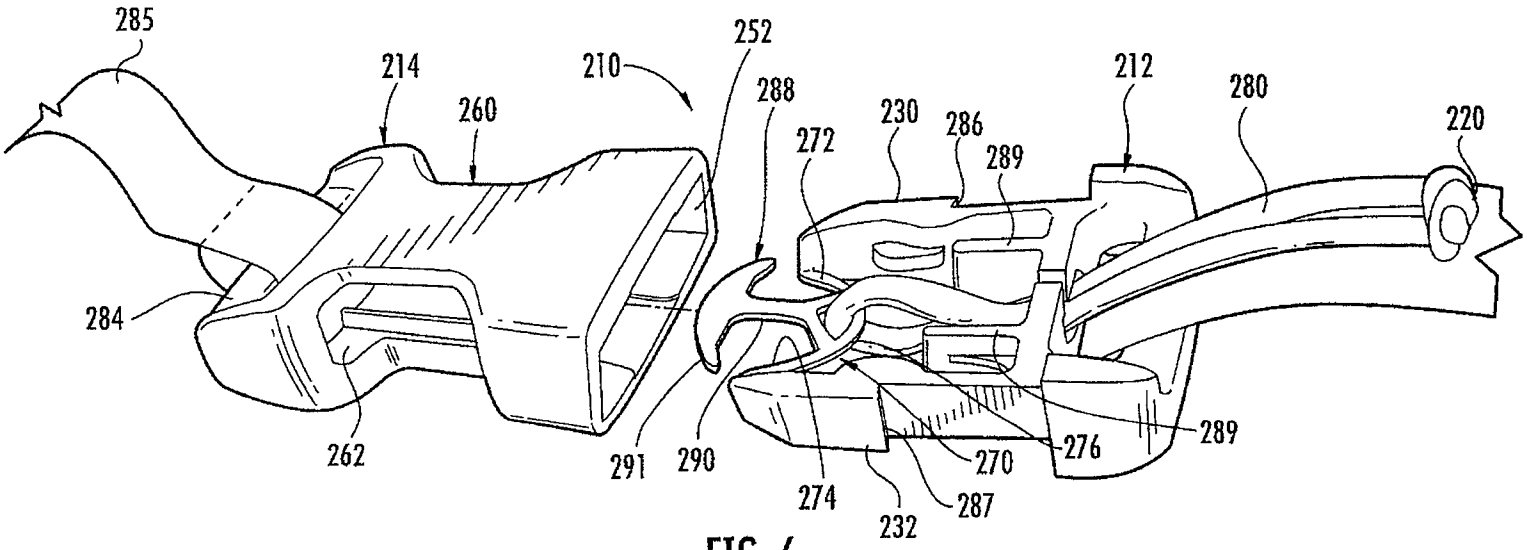

Another exemplary buckle 210 in accordance with the present invention is illustrated in FIG. 6, wherein elements corresponding to those previously described are designated by like reference numerals within a 200 series. In the exemplary construction of FIG. 6, the female component 214 includes a web attachment bar 284 adapted to engage a second web 285 or other connection element extending generally away from the web 220. Thus, the buckle 210 may define a releasable connective interface between the web 220 and the second web 285. In the exemplary configuration of FIG. 6, the bridge member 270 has a generally "U" shaped configuration wherein the bridge segments 272, 274 have a generally concave curvature. The connection zone 276 has an eyelet opening adapted engage a distal end of the release lanyard 280.

As shown, the male component 212 in the buckle 210 also includes an alignment element 288 projecting axially towards the entrance opening 252. In the illustrated exemplary construction, the alignment element 288 includes an elongate neck 290 and a cross member 291 at the distal end of the elongate neck. The cross member 291 has an enhanced width relative to the elongate neck. In the illustrated configuration the cross member 291 has a curved forward edge such that the alignment element has a generally umbrella shaped pattern. However, other geometries such as a "T" shaped configuration or the like may also be used.

Regardless of the configuration of the alignment element 288, the cross member 291 is preferably sized to guide insertion of the male component into the center of the female component in the illustrated proper orientation while blocking insertion when the male component 212 and the female component 214 are at skewed orientations relative to one another. In this regard, the cross member may be configured to ride within a predefined track at the interior of the female component 214 if desired. The use of a leading edge of convex curvature as illustrated may facilitate such central alignment.

The operation of the buckle 210 of FIG. 6 is substantially similar to that previously described in relation to other embodiments. Specifically, as latch arms 230, 232 are inserted into entrance opening 252, the latch arms 230, 232 are biased inwardly by a cam action between the chamfered edges of the latch arms and the sides of the female component 114. Once insertion is complete, the latch arms spring outwardly such that bulbous portions are held within window openings 260, 262. Outward withdrawal is blocked by shoulders 286, 287. Thus, the buckle 210 remains in a locked condition even upon the application of tension to the web 220 and the second web 285. However, when tension is applied to the release lanyard 280, the latch arms 230, 232 are pulled inwardly to an unlocked state which permits separation. Posts 289 running in substantially parallel, spaced relation to the latch arms prevent excessive inward deflection of the latch arms during release. Of course, release may also be achieved by applying inward pressure to the latch arms 230, 232 through the window openings 260, 262 if desired.

Figure 7:
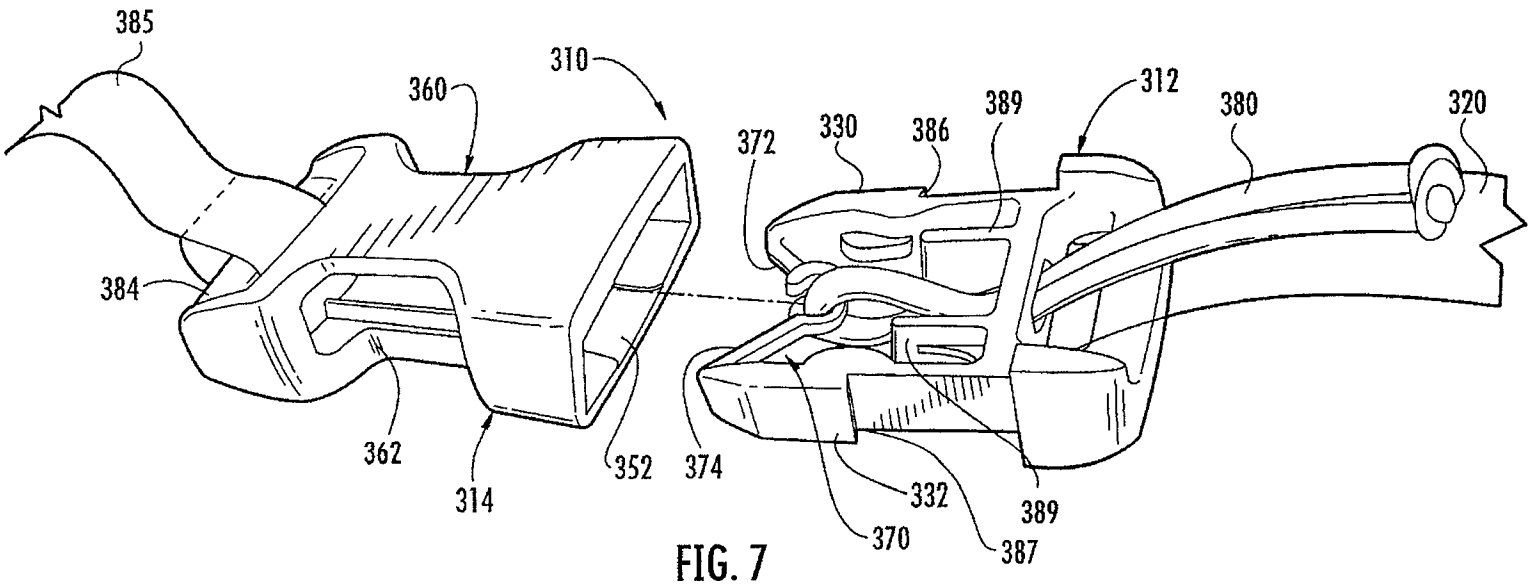

Another exemplary buckle 310 in accordance with the present invention is illustrated in FIG. 7, wherein elements corresponding to those previously described are designated by like reference numerals within a 300 series. In the exemplary construction of FIG. 7, the female component 314 includes a web attachment bar 384 adapted to engage a second web 385 or other connection element extending generally away from the web 320. Thus, the buckle 310 may define a releasable connective interface between the web 320 and the second web 385. In the exemplary configuration of FIG. 7, the bridge member 370 is formed by bridge segments 372, 374 having generally hook shaped configurations. As shown, in this configuration the release lanyard 380 is fed through the aligned hook openings.

The operation of the buckle 310 of FIG. 7 is substantially similar to that previously described in relation to other embodiments. Specifically, as latch arms 330, 332 are inserted into entrance opening 352, the latch arms 330, 332 are biased inwardly by a cam action between the chamfered edges of the latch arms and the sides of the female component 314. Once insertion is complete, the latch arms spring outwardly such that bulbous portions are held within window openings 360, 362. Outward withdrawal is blocked by shoulders 386, 387. Thus, the buckle 310 remains in a locked condition even upon the application of tension to the web 320 and the second web 385. However, when tension is applied to the release lanyard 380, the latch arms 330, 332 are pulled inwardly to an unlocked state which permits separation. Posts 389 running in substantially parallel, spaced relation to the latch arms prevent excessive inward deflection of the latch arms during release. Of course, release may also be achieved by applying inward pressure to the latch arms 330, 332 through the window openings 360, 362 if desired.

Figure 8:
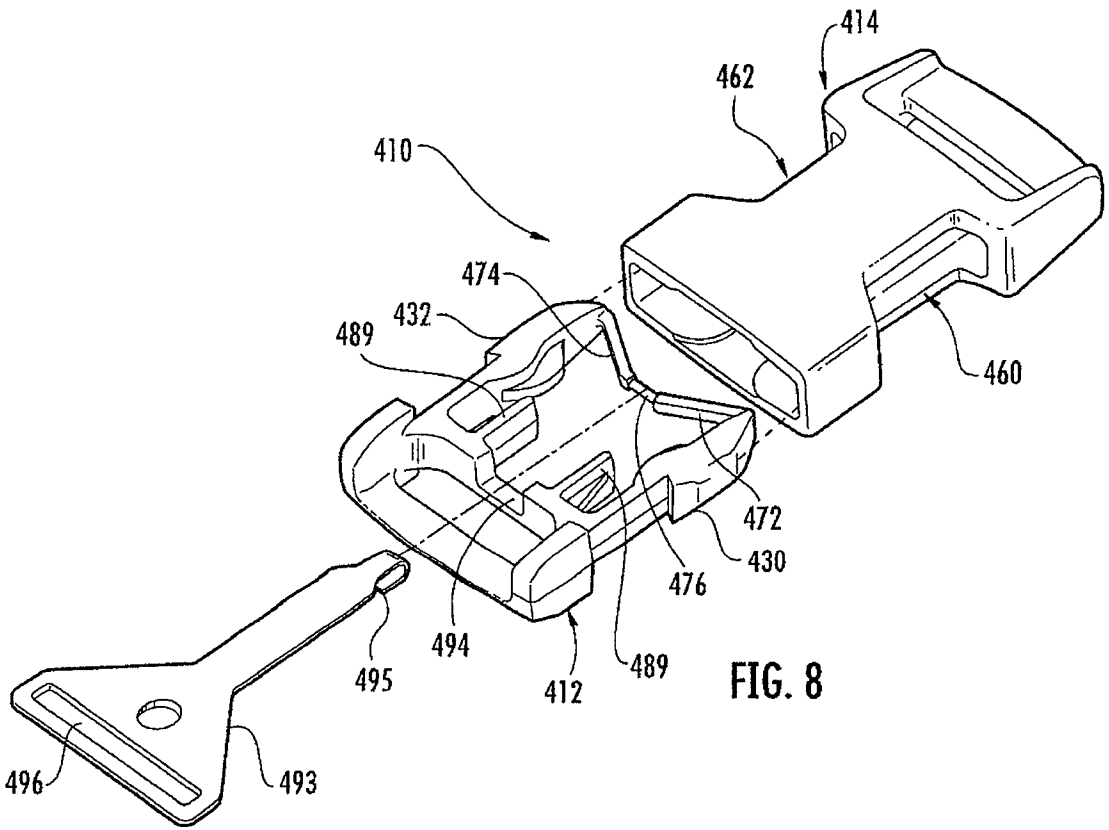
FIG. 8 is a view of an alternative exemplary buckle configuration in accordance with the present invention utilizing a tension activated release key Before the embodiments of the intention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

While the use of a release lanyard of substantially pliable construction may be desirable in many environments of use, it is likewise contemplated that any number of other release mechanisms may also be used. By way of example only and not limitation, an exemplary buckle 410 in accordance with the present invention is illustrated in FIG. 8, wherein elements corresponding to those previously described are designated by like reference numerals within a 400 series. In the exemplary construction of FIG. 8, an elongate key member 493 may be positioned within a key slot 494 within the male component 412. As shown, the key member 493 includes a distal latch hook 495 adapted to engage the reduced diameter connection zone 476 at the intersection of bridge segments 472, 474.

In operation, when tension is applied to the key member 493, the latch arms 430, 432 are pulled inwardly to an unlocked state which permits separation of the male component 12 from the female component 14. Posts 489 running in substantially parallel, spaced relation to the latch arms prevent excessive inward deflection of the latch arms during release. Of course, release may also be achieved by applying inward pressure to the latch arms 430, 432 through the window openings 460, 462 if desired.

As illustrated, the key member 493 includes a web acceptance opening 496. The web acceptance opening 496 may engage an elongate web or other release element (not shown) that can be activated by a user from a position removed from the buckle 410. Release tension may also be applied directly to the key member 493 if desired.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A buckle, comprising:

a female buckle component including an entrance opening;

a male buckle component including a latch portion adapted to be inserted into the female buckle component through the entrance opening to lock the male buckle component with the female buckle component, the latch portion including a first lock arm and a second lock arm, the first lock arm and the second lock arm being spaced away from one another, the first lock arm including a first distal portion and a first proximal portion, the second lock arm including a second distal portion and a second proximal portion;

a flexible bridge member extending in depressed profile spanning relation between the first lock arm and the second lock arm, the bridge member including a first bridge segment extending in angled relation away from the first distal portion of the first lock arm, a second bridge segment extending in angled relation away from the second distal portion of the second lock arm, and a connection zone extending between the first bridge segment and the second bridge segment and protruding away from the first bridge segment and the second bridge segment and towards the proximal portions; and an elongated tensioning member connected to the bridge member at the connection zone between the first lock arm and the second lock arm, the elongated tensioning member extending rearwardly away from the connection zone to a position outside the buckle, wherein when the male buckle component is locked with the female buckle component, the connection zone is adapted to be drawn by the tensioning member towards the entrance opening upon application of a tensioning force along the tensioning member to partially fold the bridge member onto itself and to pull the first lock arm and the second lock arm towards one another and to further unlock the male buckle component from the female buckle component.

2. The buckle as recited in claim 1, wherein the bridge member is a single piece structure.

3. The buckle as recited in claim 2, wherein the bridge member is integral with the first lock arm and the second lock arm.

4. The buckle as recited in claim 1, wherein the bridge member is a multi-piece structure.

5. The buckle as recited in claim 1, wherein the first bridge segment and the second bridge segment have a substantially convex curvature along respective lengths of the first bridge segment and the second bridge segment.

6. The buckle as recited in claim 1, wherein the first bridge segment and the second bridge segment have a substantially concave curvature along respective lengths of the first bridge segment and the second bridge segment.

7. The buckle as recited in claim 1, wherein the first bridge segment and the second bridge segment are substantially linear along respective lengths of the first bridge segment and the second bridge segment.

8. The buckle as recited in claim 1, wherein further comprising an alignment element projecting away from the bridge member in the direction of insertion of the latch portion through the entrance opening, the alignment element including an enhanced diameter distal end adapted to guide insertion of the latch portion through the entrance opening in a predefined orientation.

9. The buckle as recited in claim 8, wherein the alignment element has a generally umbrella shaped configuration.

10. The buckle as recited in claim 1, wherein the female buckle component includes a perimeter skirt disposed at least partially around an exterior of the female buckle component.

11. The buckle as recited in claim 1, wherein the male buckle component further comprises a pair of protruding members provided side by side between the first and second lock arms for preventing excessive inward deflection of the first and second lock arms during unlocking of the male buckle component from the female buckle component, and the tensioning member is located between the pair of protruding members.

12. The buckle as recited in claim 1, wherein the tensioning member is a loop having a first region extending across the connection zone and a second region to be secured at the position outside the buckle.

13. The buckle as recited in claim 1, wherein the connection zone has a U shape open in a direction away from the proximal portions.

14. A buckle, comprising:

a female buckle component including an entrance opening;

a male buckle component including a latch portion adapted to be inserted into the female buckle component through the entrance opening to lock the male buckle component with the female buckle component, the latch portion including a first lock arm and a second lock arm, the first lock arm and the second lock arm being spaced away from one another, the first lock arm including a first distal portion and a first proximal portion, the second lock arm including a second distal portion and a second proximal portion relative to the entrance opening;

a flexible bridge member extending in depressed profile spanning relation between the first lock arm and the second lock arm, a first bridge segment normally extending in angled relation away from the first distal portion of the first lock arm, a second bridge segment extending in angled relation away from the second distal portion of the second lock arm, and a connection zone extending between the first bridge segment and the second bridge segment and protruding away from the first bridge segment and the second bridge segment and towards the proximal portions; and a pliable lanyard connected to the bridge member at the connection zone between the first lock arm and the second lock arm, the pliable lanyard extending rearwardly away from the connection zone to a position outside the buckle, wherein when the male buckle component is locked with the female buckle component, the connection zone is adapted to be drawn towards the entrance opening upon application of a tensioning force along the pliable lanyard to partially fold the bridge member about the connection zone onto itself and to pull the first lock arm and the second lock arm towards one another and to further unlock the male buckle component from the female buckle component.

15. The buckle as recited in claim 14, wherein the bridge member is integral with the first lock arm and the second lock arm.

16. The buckle as recited in claim 14, wherein the first bridge segment and the second bridge segment have a substantially convex curvature along respective lengths of the first bridge segment and the second bridge segment.

17. The buckle as recited in claim 14, wherein the first bridge segment and the second bridge segment have a substantially concave curvature along respective lengths of the first bridge segment and the second bridge segment.

18. The buckle as recited in claim 14, wherein the first bridge segment and the second bridge segment are substantially linear along respective lengths of the first bridge segment and the second bridge segment.

19. The buckle as recited in claim 14, further comprising an alignment element projecting away from the bridge member in the direction of insertion of the latch portion through the entrance opening, the alignment element including an enhanced diameter distal end adapted to guide insertion of the latch portion through the entrance opening in a predefined orientation.

20. The buckle as recited in claim 19, wherein the alignment element has a generally umbrella shaped configuration.

* * * * *